US009850061B2

(12) United States Patent
Pålsson

(10) Patent No.: US 9,850,061 B2
(45) Date of Patent: Dec. 26, 2017

(54) PACKAGE

(71) Applicant: SANDVIK INTELLECTUAL PROPERTY AB, Sandviken (SE)

(72) Inventor: Claes Pålsson, Gävle (SE)

(73) Assignee: SANDVIK INTELLECTUAL PROPERTY, AB, Sandviken (SE)

( * ) Notice: Subject to any disclaimer, the term of this patent is extended or adjusted under 35 U.S.C. 154(b) by 0 days.

(21) Appl. No.: 13/887,444

(22) Filed: May 6, 2013

(65) Prior Publication Data

US 2013/0292282 A1 Nov. 7, 2013

(30) Foreign Application Priority Data

May 7, 2012 (SE) ..... 1250463-5

(51) Int. Cl.
*B65D 85/30* (2006.01)
*B65D 75/22* (2006.01)
*B65D 75/24* (2006.01)

(52) U.S. Cl.
CPC ..... *B65D 85/30* (2013.01); *B65D 75/22* (2013.01); *B65D 75/24* (2013.01)

(58) Field of Classification Search
CPC ..... B65D 73/0035; B65D 73/0057; B65D 73/0092; B65D 75/22; B65D 75/24; B65D 75/323; B65D 21/0235; B65D 21/046; B65D 21/0222; B65D 21/0223
USPC ..... 206/349, 470–471, 806
See application file for complete search history.

(56) References Cited

U.S. PATENT DOCUMENTS

| | | | | |
|---|---|---|---|---|
| 5,090,570 | A | 2/1992 | Todd | |
| 5,755,323 | A * | 5/1998 | Zahn et al. | 206/318 |
| 6,012,580 | A * | 1/2000 | Peters et al. | 206/470 |
| 6,216,866 | B1 | 4/2001 | Schoenberg | |
| 7,204,367 | B2 * | 4/2007 | Bott et al. | 206/219 |
| 2005/0133389 | A1 * | 6/2005 | Baublitz et al. | 206/303 |
| 2010/0122923 | A1 | 5/2010 | Chin | |

FOREIGN PATENT DOCUMENTS

| | | | |
|---|---|---|---|
| CN | 201136640 | Y | 10/2008 |
| DE | 29520369 | U1 | 4/1997 |
| DE | 19958738 | A1 | 6/2001 |
| JP | S60195783 | U | 12/1985 |
| JP | 2006248590 | A | 9/2006 |

* cited by examiner

*Primary Examiner* — Robert Poon
(74) *Attorney, Agent, or Firm* — Corinne R. Gorski

(57) ABSTRACT

A package has two panels, one of which is a base part having at least one bubble that is intended for storage purposes. The bubble projects from an underside of the panel of the base part and opens into an opening in the upper side thereof. The other panel is a cover that is connected with the base part via a hinge in order to be rotatable between a raised position, in which the interior of the bubble is accessible, and a lowered position in which the panel of the cover covers the opening of the bubble. The panels of the base part and cover are each formed with two seats that in the lowered position of the cover are laterally and equidistantly separated from the bubble. The package allows exposure of information of one or two storage objects, while being stacked together with other packages in a compact pile.

14 Claims, 10 Drawing Sheets

PACKAGE

RELATED APPLICATION DATA

This application claims priority under 35 U.S.C. §119 to Swedish Patent Application No. 1250463-5, filed on May 7, 2012, which the entirety thereof is incorporated herein by reference.

TECHNICAL FIELD OF THE INVENTION

This invention relates to a package of the type that comprises two panels, one of which is included in a base part, which includes a bubble that is intended for storage purpose and projects downward from an under side of the panel and mouths in an opening in the upper side thereof, while the other panel is included in a cover, which is connected with the base part via a hinge in order to be turnable between a raised position, in which the interior of the bubble is accessible, and a lowered position, in which the panel of the cover covers the opening of the bubble.

TERMINOLOGY

To the above generally mentioned type of packages, so-called blister packs belong. Such packages have received their denomination as a consequence of they being formed with one or more "bulgings", "blisters", "cavities" or "bubbles", which project from at least one side of a panel, and in which one or more comparatively small articles can be stored, usually in a state that is visible from outside and has been provided by the fact that the material in the package is transparent. Henceforth in this document, solely the concept "bubble" will be used.

Furthermore, in order to create conceptual clarity, the definitions characterizing different details of the invention will relate to a specific spatial location, in which the two panels of the package are horizontally oriented, and in which the cover is assumed to be lowered against the base part and sealing the package. In this assumed state, an under side of the panel of the cover abuts against an upper side of the panel included in the base part, at the same time as the bubble projects downward from the under side of the last-mentioned one. In this state, the gravitation retains the article that is positioned in the bubble, when the package is opened by the cover being raised from the base part.

BACKGROUND OF THE INVENTION

The basis of the invention are problems that are connected with manufacture, distribution and handling of replaceable cutting inserts for tools for chip removing machining of above all workpieces of metal or composites, such as turning, milling, or drilling. The proper tools are usually manufactured from steel, while the chip removing cutting inserts are manufactured from a harder and more wear-resistant material, such as cemented carbide, cermet, etc., that allows the forming of utmost sharp cutting edges. In spite of their relative resistance to wear, the cutting inserts are, however, wear parts, because the same have a limited service life (at times 5-15 min) and which therefore are consumed in large quantities. Most manufacturers have in addition developed not only a large number of tool types, but also myriads of insert types; all with the purpose of optimizing the performance of the tools/cutting inserts in most varying applications. Large-scale manufacturers may accordingly provide 100-150 000 different types of cutting inserts.

Against the above background, the logistics between the mass-producing manufacturer and the individual machine operator using the cutting inserts is in many cases complicated and multifaceted. A factor contributing to complicate the logistics is that the buyers are differently large. Some are small and only consume few cutting inserts, while others are large or medium-sized and consume greater quantities. For instance, large workshops may have a daily total need of thousands of cutting inserts, although these are distributed in smaller and varying sets in different machines. For the machining of a certain workpiece, one turning insert, four milling inserts and two drill cutting inserts may perhaps be required.

A previously known and widely spread package for cutting inserts is in the form of a box that is manufactured from form-stiff plastic and includes on one hand a trough part having a plurality of individual pigeon-holes, and on the other hand a sliding lid. In a standard embodiment, such boxes include pigeon-holes distributed in two rows having five pigeon-holes in each row, i.e., in total ten individual pigeon-holes. After manufacture, the cutting inserts are filled into these pigeon-holes by an automatized process, usually by means of a picking robot. More precisely, the ten pigeon-holes are loaded with cutting inserts of one and the same type, the box being provided with information relevant to exactly this insert type. However, the practical consumption of the cutting inserts rarely or never takes place in sets of exactly ten and ten. On the contrary, the consumption most often takes place in a most varying way, irrespective of whether or not the buyer is a large-scale consumer. At times, a certain machining, e.g. a single, external turning of a workpiece, may accordingly require only one or a few cutting inserts. In such cases, the other cutting inserts in a box of ten inserts have to be handled in a particular order. In certain cases, the excess cutting inserts are repacked in provisional packages, e.g. plastic bags, or the box will simply be lying, most often without tidiness, in the surroundings of the machine.

With the purpose of creating tidiness in the workshop and getting better control of the consumption, particular automatic machines or dispenser apparatuses have recently been installed that are loaded with individual cutting inserts, which are picked out one by one by the authorized machine operator, who can open the automatic machine by means of a magnetic card or code memory board. However, these machines require that the cutting inserts are stored individually. When a standard box with, e.g., ten cutting inserts arrives to the workshop, the same therefore has to be repacked in one-piece packages, usually in the form of plain plastic bags that are suspended on a spear in the automatic machine. Such repackings are not only time-consuming and costly, but also entails that the cutting edges of the cutting inserts are damaged. This way of opening a box of ten inserts and by hand picking over the cutting inserts into small bags or other provisional one-piece packages, also entails several other disadvantages. Among other things, the information included in the original box is lost. Often, this information is utmost important for a good machining result because it features a lot of insert data, information about origin, warning notes, etc.

Objects and Features of the Invention

The present invention aims at obviating the disadvantages of previously known insert packages and at providing a package that is particularly suitable for the storage and distribution of cutting inserts from a mass-producing manufacturer to individual buyers. Therefore, a primary object of the invention is to provide a package that is intended for the containment of only one or at most two cutting inserts and, on one hand, has a surface extension that is sufficiently large to effectively expose all the information required for allowing utilizing the cutting insert in question in an optimal way, but, on the other hand, can be piled or packed in a space-saving way. An additional object is to provide a package that allows a reliable control and guidance of most varying flows of cutting inserts from the manufacturer to the buyer. Among other things, the individual cutting insert should, by means of the package, be traceable all the way back from the machine operator (e.g. after a breakdown has occurred or an inferior work result) to the original manufacturer. The package should furthermore, when it is opened or broken, be able to convince the machine operator that the cutting insert in question originates from exactly the indicated manufacturer.

In order to achieve at least the primary object, the package defined by way of introduction is characterized in that the panels of the base part as well as of the cover comprises two seats, which—in the lowered position of the cover—are laterally and equidistantly separated from the storage bubble. In this way, the packages can be piled or packed close to each other without unnecessary space in the direction perpendicular to the panels being occupied. More precisely, the lower half of a protruding bubble can be inserted into an open seat when adjacent packages have been rotated in relation to each other (90° and 120°, respectively, according to the embodiment examples).

In a feasible embodiment, the individual seat as well as the bubble has a no circular contour shape.

In one embodiment, the bubble may, in addition to a bottom, include an endless wall having a rotationally symmetrical shape that extends between the bottom and the opening in the appurtenant panel. By its round shape, the bubble can be formed in a simple way because sharp corners are lacking.

In the last-mentioned embodiment, the endless wall may converge in the direction from the opening of the bubble toward the bottom thereof. In other words, the bubble is given—at least partly—a conical or tapering shape, which facilitates the insertion of the bubble into the individual seat and which also can be utilized to keep together adjacent packages in a bundle.

In one embodiment, the base part of the package is formed with two bubbles, which are mutually separated and located along a straight, first reference line, while the seats are located along a second reference line perpendicular to the same, the mutual distance between the bubbles being equal to the distance between the seats. When several packages are to be piled or packed together into a uniform set, the individual package is rotated 90° in relation to an adjacent package, the pair of bubbles fitting into the pair of seats in the adjacent package.

In a further embodiment, the panels of the cover and of the base part transform along peripheries into downwardly extending borders, the border of the cover of which is located on the outside of the one of the base part, when the cover is lowered. By means of these borders, the cover as well as the base part is stiffened separately, at the same time as the sealed package in its entirety obtains a good stiffness and strength. The height or depth of the borders amounts advantageously to half of the depth of the individual bubble. In such a way, the build height that arises when several packages are piled on each other is halved.

In the last-mentioned embodiments, the individual border along a lower boundary line may transform into a plane brim that protrudes laterally from said boundary line. Such brims contribute to stiffen the proper borders, so that these do not bend along their lower edges. In addition, the brims may be utilized to provide means for the suspension of the package as well as to provide a reliable locking of the cover in relation to the base part.

In a further developed embodiment, the above-mentioned brims may be extended, so that parts of the same form bottoms in the individual seats. In such a way, the individual bubble obtains a stable support, when it is inserted into the seat, at the same time as the comparatively narrow, central portion of each panel, which is present between two seats, is stiffened.

In yet an embodiment, the individual seat is delimited by a round wall running at an arc angle, which is greater than 180° but less than 360°, wherein the seat opens laterally. In this way, the package may be given a rectangular, elongate shape, which is distinguished by the fact that the rectangle has its greatest extension in the direction of the first reference axis, along which the bubbles are situated.

In one embodiment, the two panels may have a rectangular contour shape, the appurtenant borders including four corner portions, at least the two of which, which are farthest spaced apart from the hinge, include co-operating snap means having the purpose of snapping in the cover in its lowered position against the base part. By giving the panels, and thereby the package in its entirety, a rectangular basic shape, the package formed with two storage bubbles can be given a shape that, on one hand, has a sufficiently large surface area to be able to house a large number of information, but that, on the other hand, allows the packages to be piled or packed close to each other in a set having a limited volume.

In the last-mentioned embodiment, the material of the base part as well as of the cover may be transparent, besides which an information carrier, in the form of a sheet folded in two, is introduced between the under side of the panel included in the cover and the upper side of the panel included in the base part. In such a way, external information on the sheet can be seen from the upper side of the package as well as from its under side (at the same time as the proper cutting insert can be seen from the outside of the bubble). In addition, the sheet may carry internal information that can be read when the cover is raised.

In a preferred embodiment, the projection area of the individual panel may be at least three times larger than the total projection area of the two seats. In relation to the size of the stored articles and bubbles, thereby the available space for the exposure of information becomes ample.

In an embodiment intended for the storage of only one cutting insert, the base part of the package is formed with a solitary bubble, which is situated in a corner of an imaginary, equilateral triangle, in the two other corners of which the two seats are situated. In this case, the package can be realized in a very simple and cost-effective embodiment that allows dense packing when the individual packages have been rotated 120° in relation to each other.

In the last-mentioned embodiment, the seats may be through holes through the panels of the cover and of the base part, at least one of the panels no including spacer members, which have a height that amounts to one-third of the depth of the bubble. In such a way, three packages can be packed together into a pile set, the total build height of which is not more than the depth of the individual bubble.

In the last-mentioned embodiments, the individual spacer member may be a bulge situated in the vicinity of the individual hole. In this way, a stable three-point support is obtained for the individual packages in a piled or packed-up package set.

PRIOR ART

By, for instance, U.S. Pat. No. 6,024,222 and U.S. Pat. No. 5,794,781, blister packs are previously known having a plurality of (more precisely seven) bubbles that project from one side of two panels foldable against each other, the bubbles being arranged so that each individual bubble on one of the panels is housed in a space between two bubbles on the other panel. In this case, however, the packages include no externally accessible seats at all in order to facilitate stapling or packing together of the sealed packages close to each other.

BRIEF DESCRIPTION OF THE APPENDED DRAWINGS

In the drawings:

FIG. 1 is a top view showing an embodiment of a package according to

Figure 1:
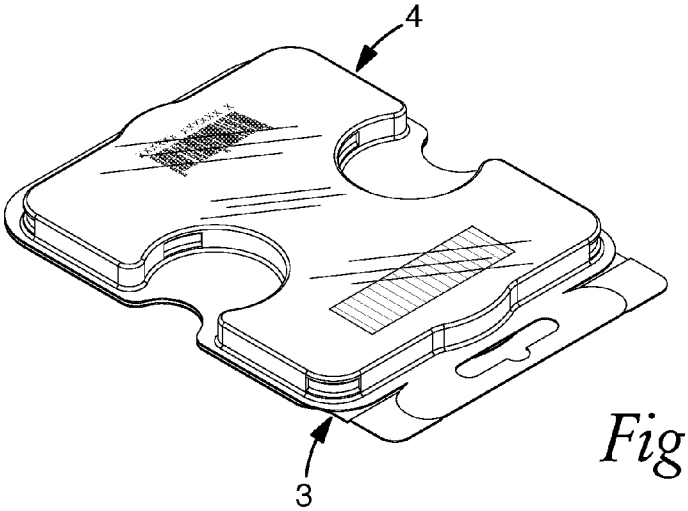
Figure 2:
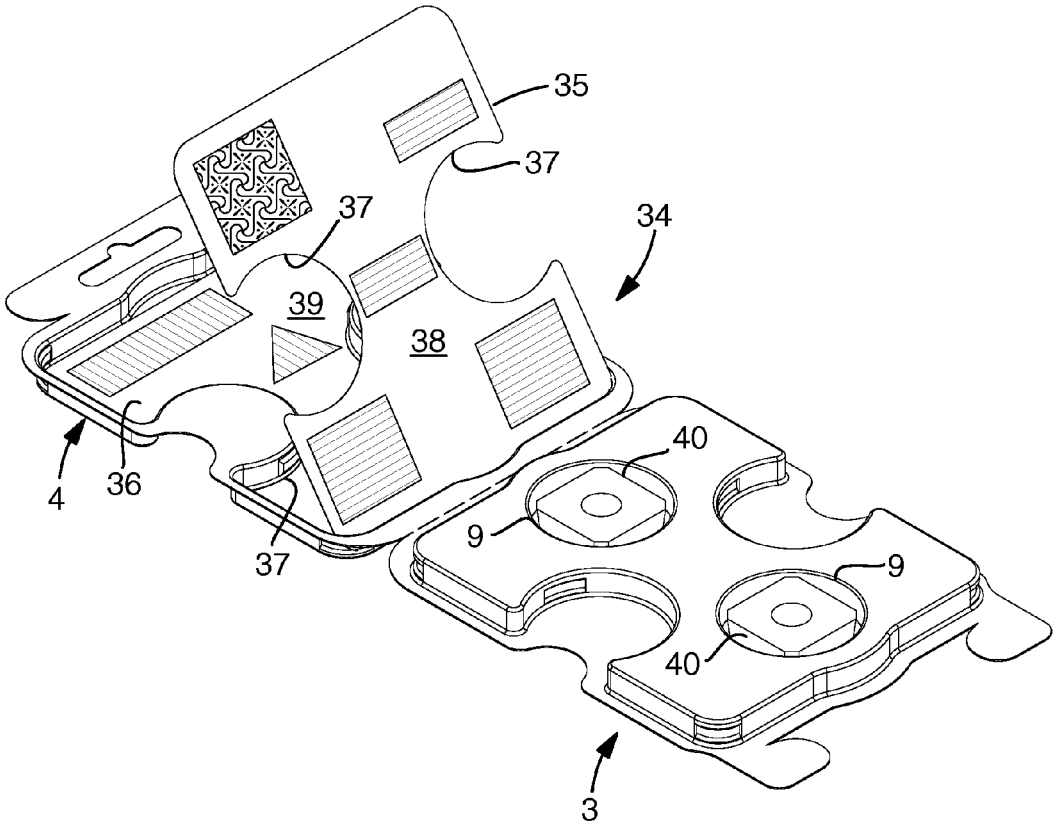
FIG. 2 is an analogous top view showing the same package in an opened
Figure 3:
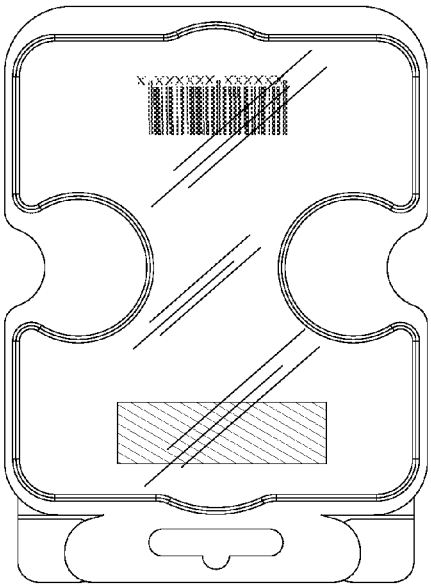
FIG. 3 is a planar view from above of the sealed package.
Figure 4:
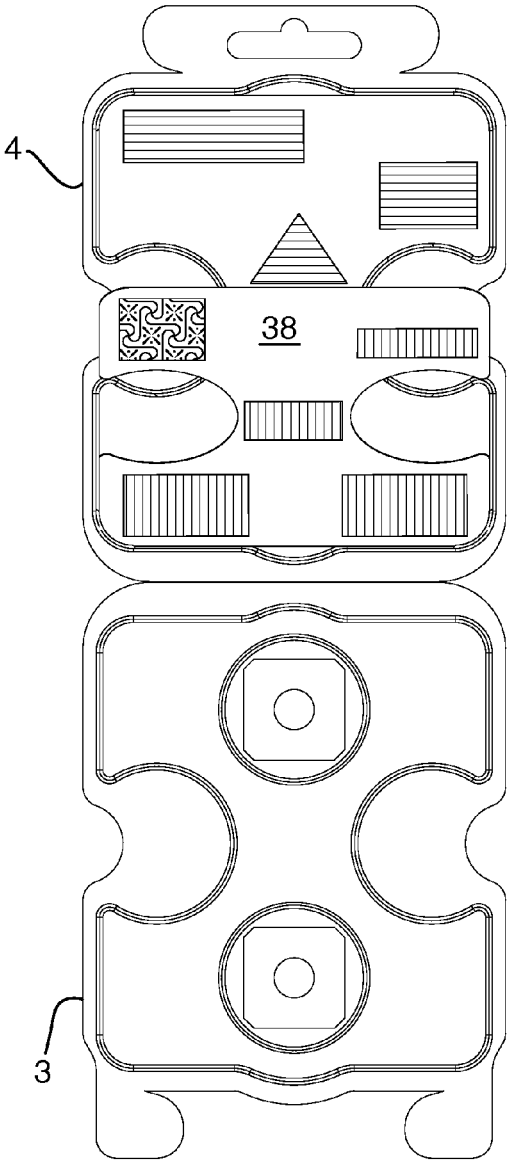
Figure 5:
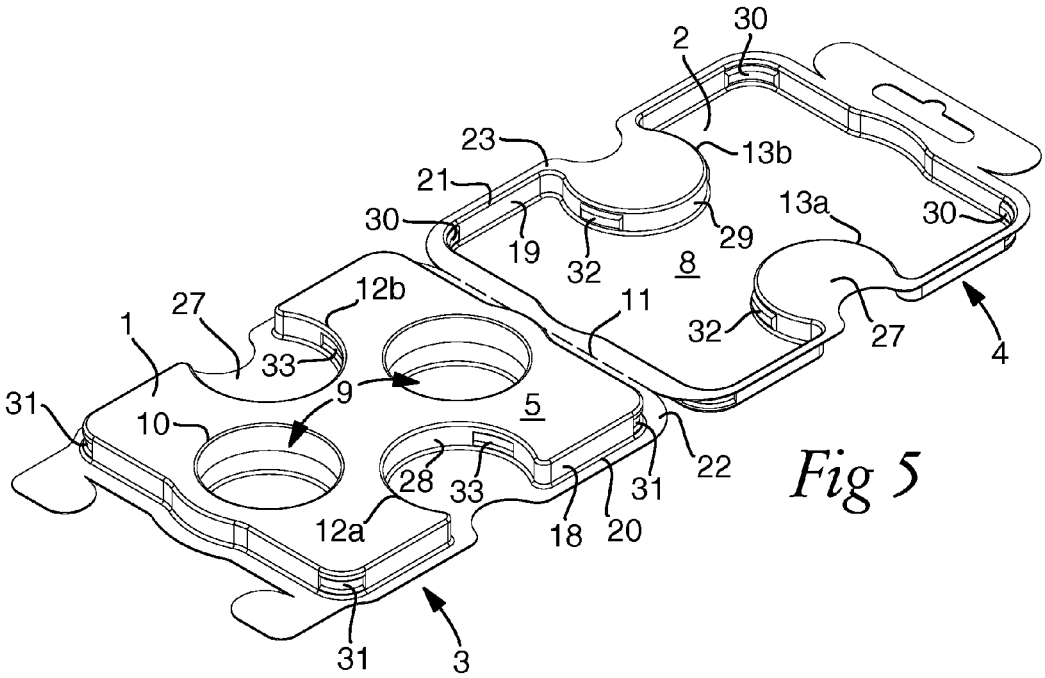
Figure 6:
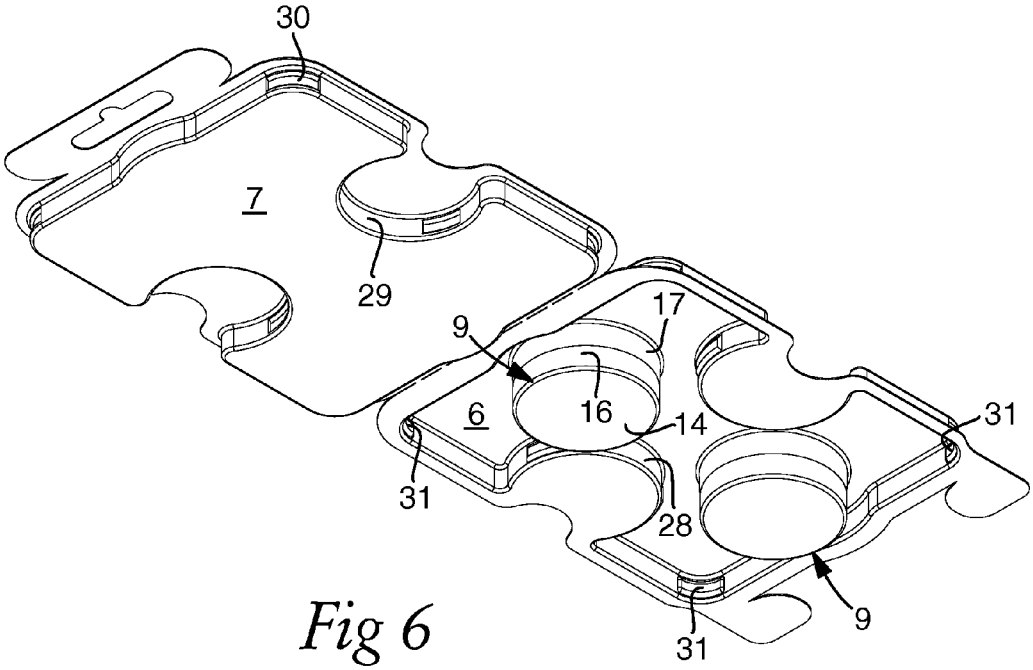
Figure 7:
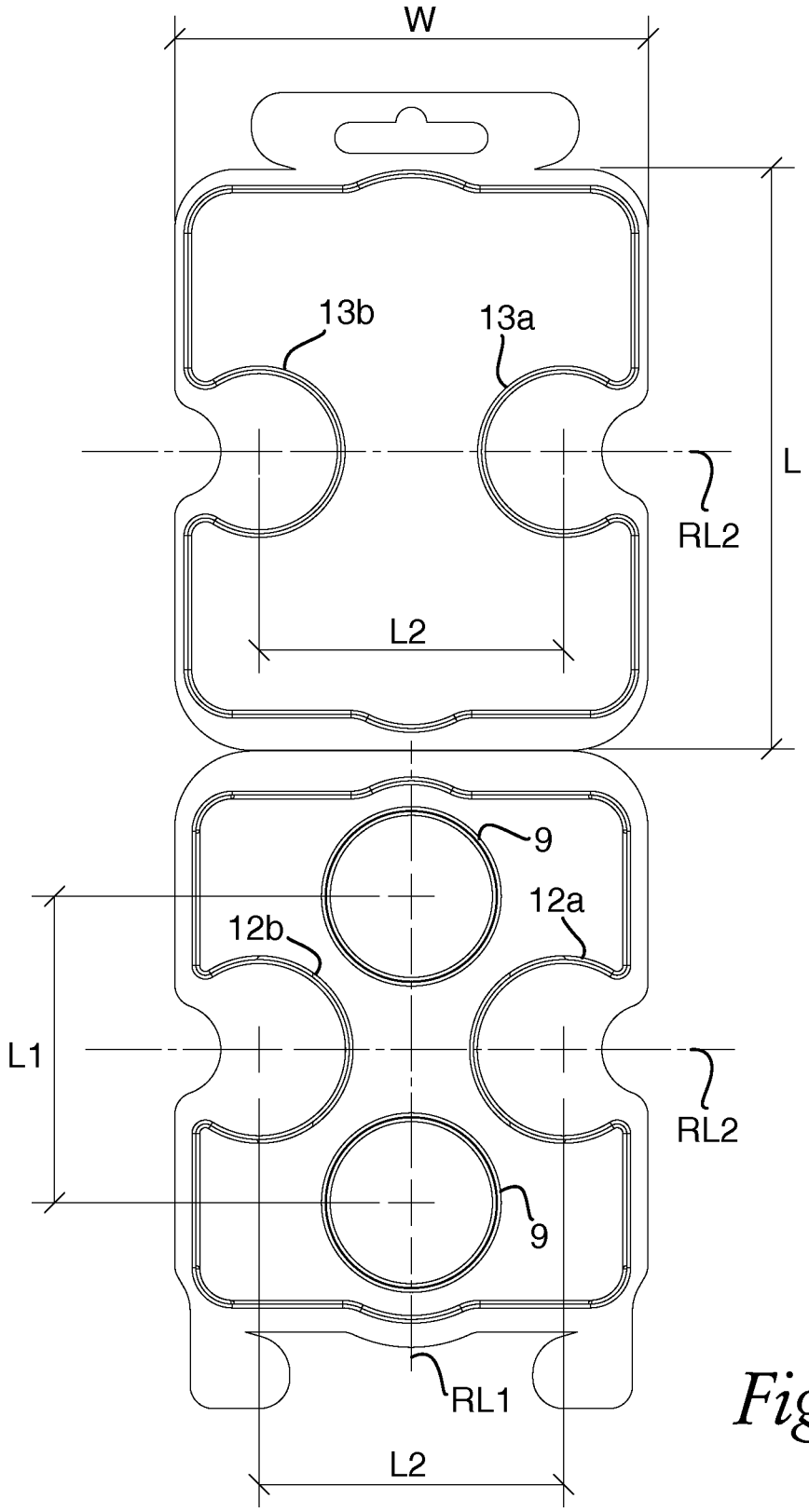
Figure 8:
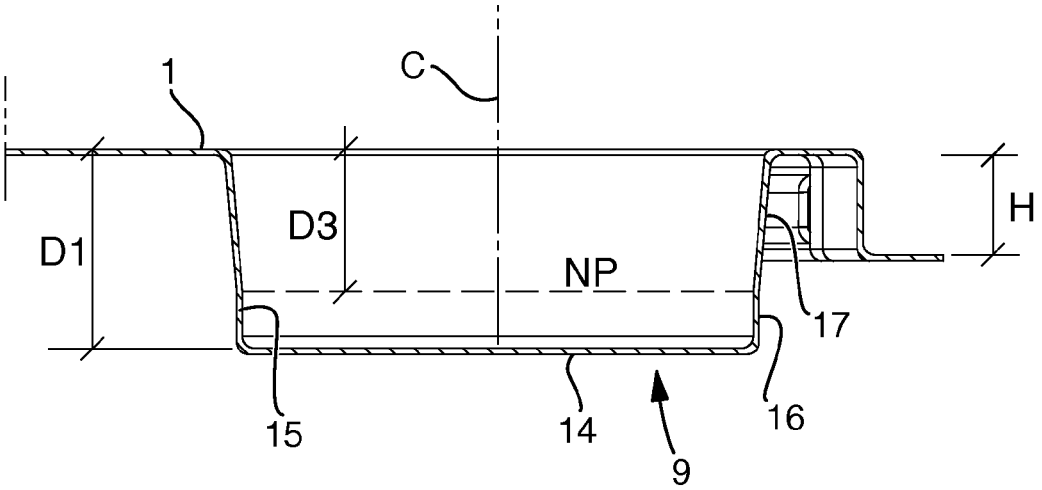
Figure 8:
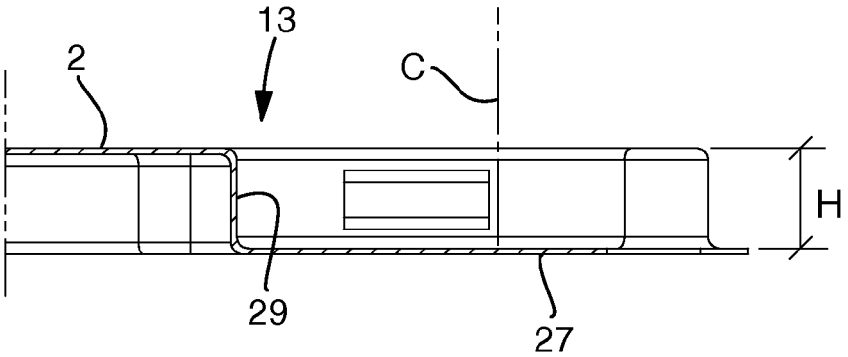
Figure 9:
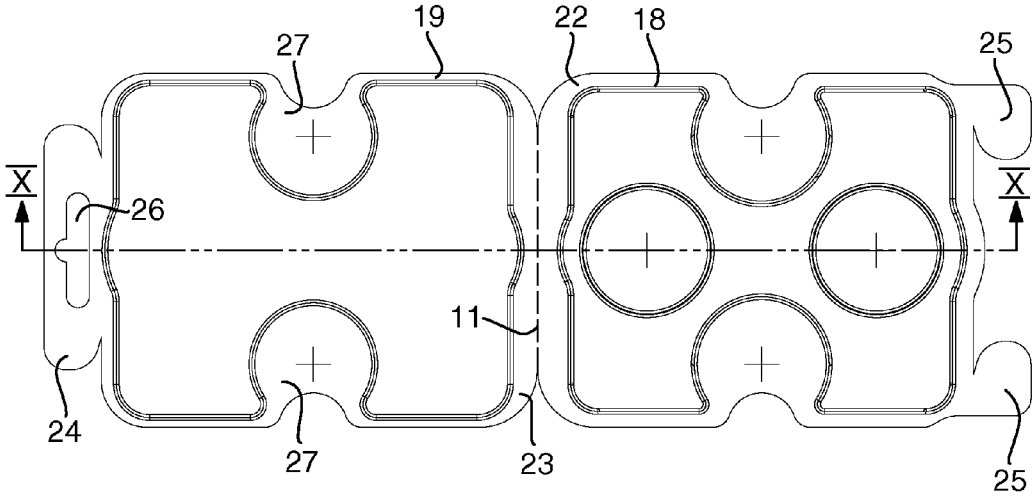
Figure 10:
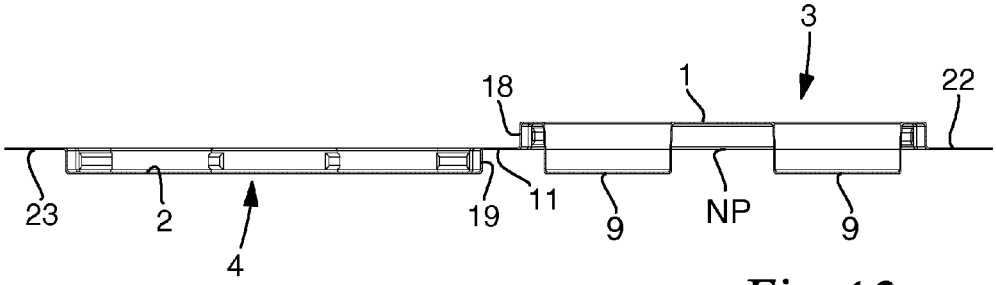
Figure 11:
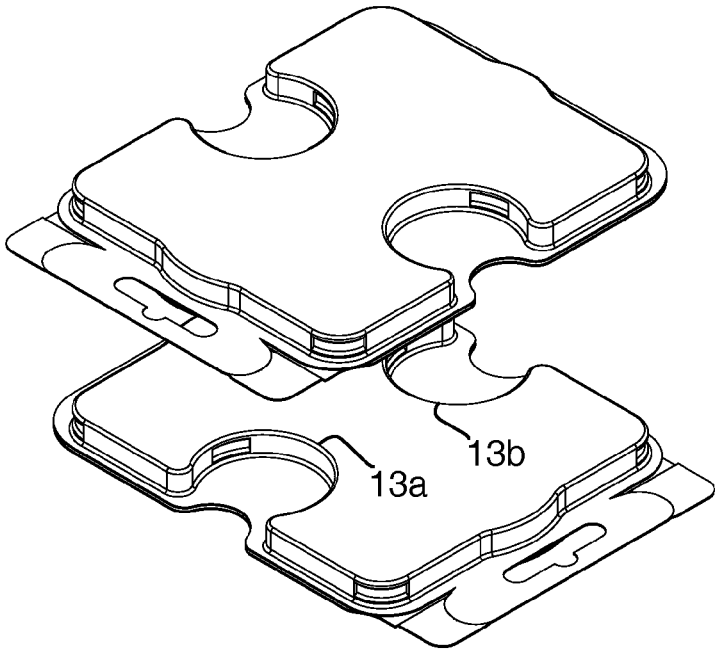
Figure 12:
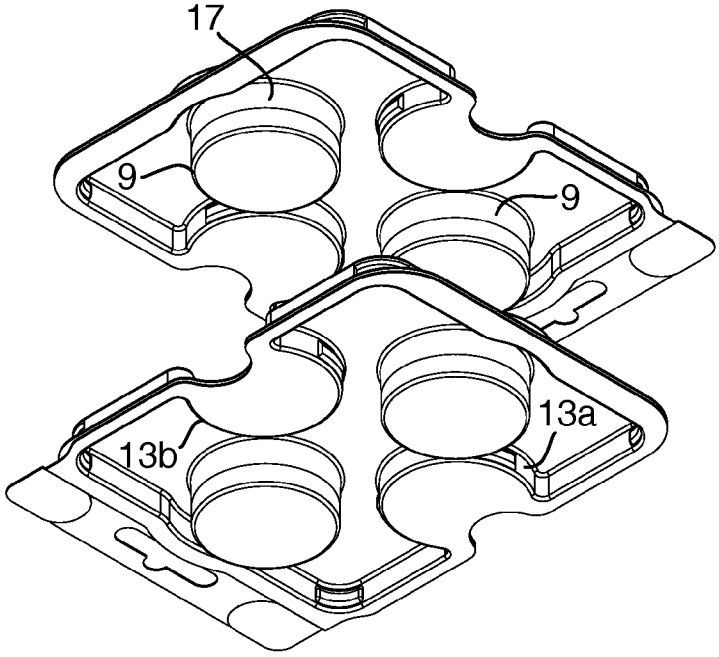
Figure 13:
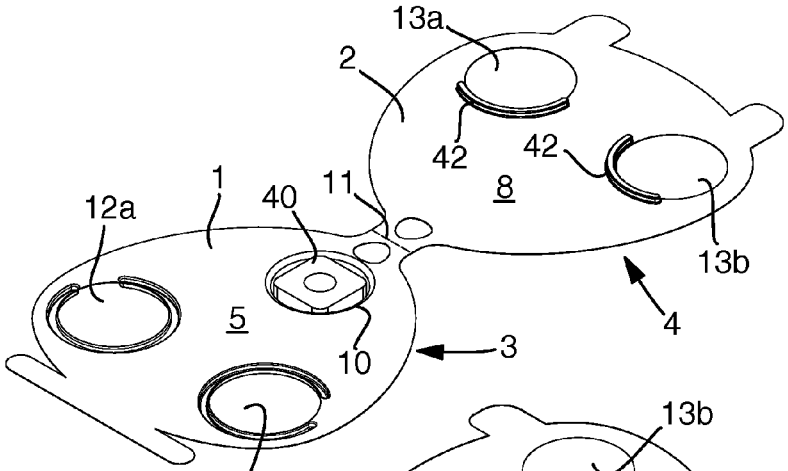
Figure 14:
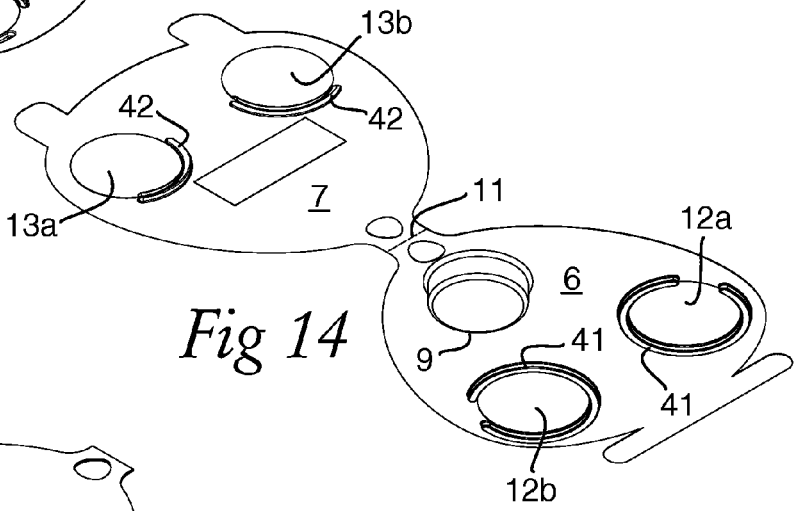
Figure 15:
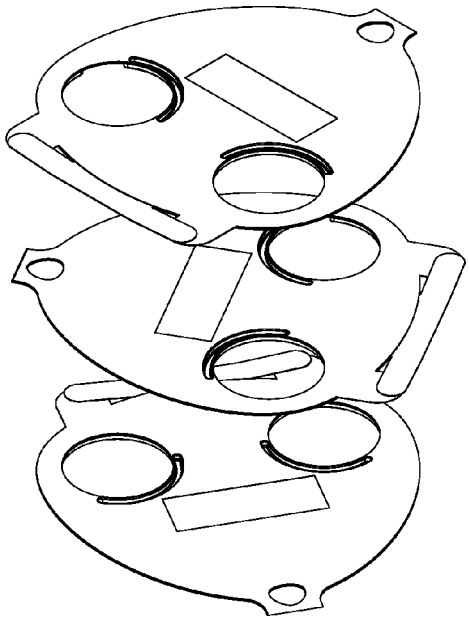
Figure 16:
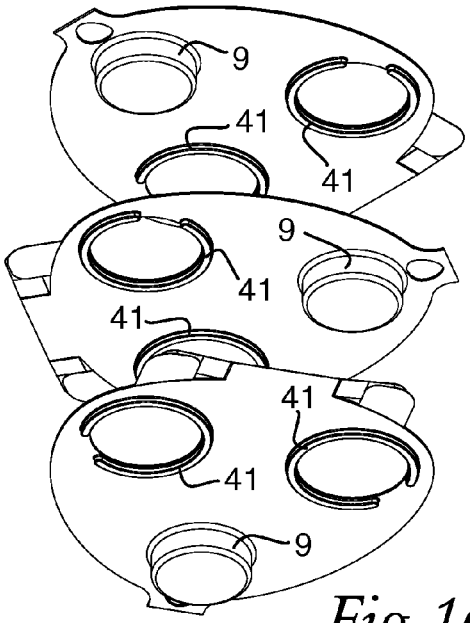
Figure 17:
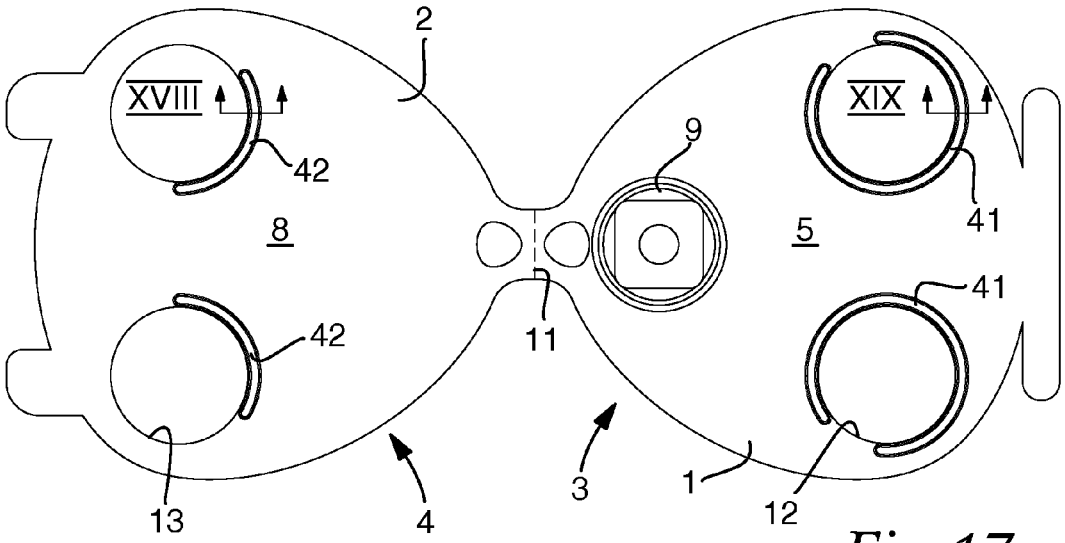
Figure 18:
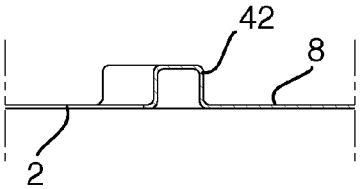
Figure 19:
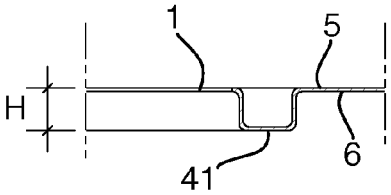
Figure 20:
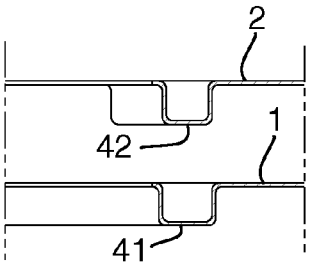
Figure 21:
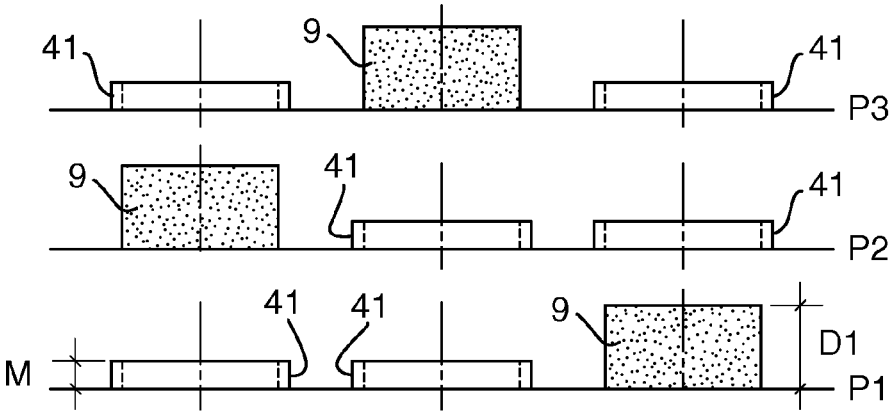
Figure 22:
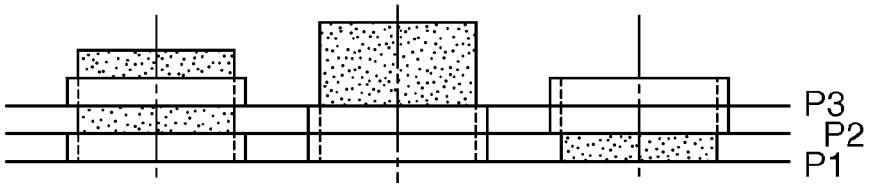
Figure 22:
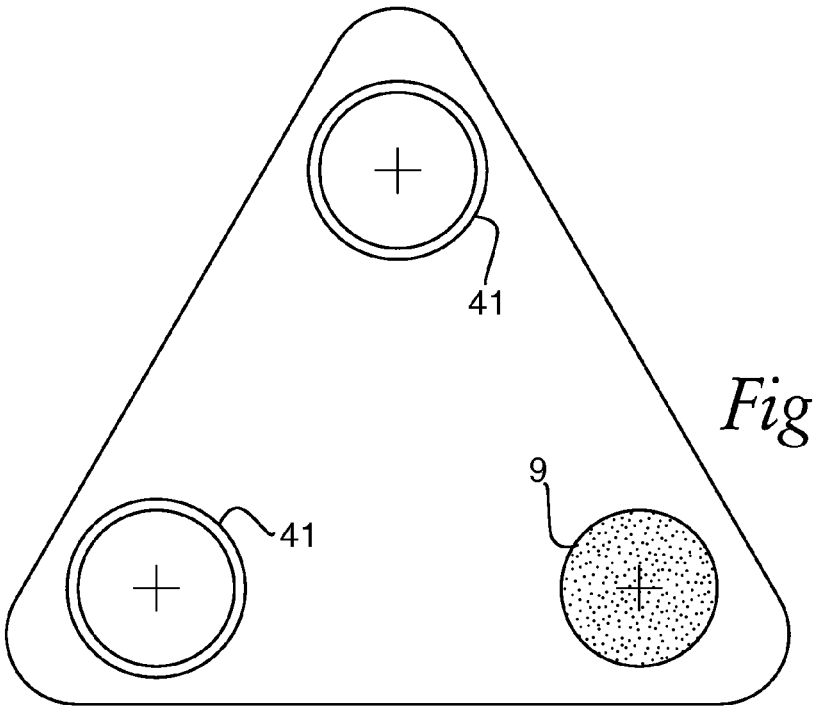

FIG. 4 is a planar view from above of the package in the opened state according to FIG. 2, FIG. 5 is a top view of the package in an opened state without information FIG. 6 is a bottom view of the same package, FIG. 7 is a dimensioned planar view of the package in the opened state, FIG. 8 is an exploded view of a bubble included in the package and a seat co-operating with the same in an enlarged state, FIG. 9 is a further planar view of the open package as viewed from above, FIG. 10 is a longitudinal section X-X in FIG. 9, FIG. 11 is a top view showing two sealed packages about to be piled on FIG. 12 is a bottom view of the packages according to FIG. 11, FIG. 13 is a top view of an alternative embodiment of the invention, the FIG. 14 is a bottom view of the package according to FIG. 13, FIG. 15 is a top view of three sealed packages about to be piled or packed FIG. 16 is a bottom view of the packages according to FIG. 15, FIG. 17 is a planar view of the package having the cover folded out, FIG. 18 is an enlarged detailed section XVIII in FIG. 7, FIG. 19 is a detailed section XIX in FIG. 17, FIG. 20 is a further detailed section, FIG. 21 is a schematic exploded view showing three packages about to be piled on each other, and FIG. 22 is a schematic planar view illustrating the situation of the lowermost package in FIG. 21.

DETAILED DESCRIPTION OF PREFERRED EMBODIMENTS OF THE INVENTION

Below, two alternative embodiments of the invention will be described, reference being made to FIGS. 1-12 and FIGS. 13-22, respectively. Among these, the first embodiment includes two storage bubbles, while the second one includes only one bubble. In both cases, the package is assumed to be manufactured from a comparatively thin, transparent plastic (e.g. PET), the thickness of which is selected so that the included parts obtain a semi-rigid structure, at the same time as they are partly bendable and resilient.

As may be best seen in FIGS. 5 and 6, the embodiment according to FIGS. 1-12 includes two panels 1, 2, the first-mentioned one of which is included in a base part generally designated 3, while the other is included in a cover generally designated 4. The upper side of the first panel 1 is designated 5, while the under side is designated 6. In an analogous way, the upper and under sides of the panel 2 included in the cover 4 are designated 7, 8. As previously pointed out, said definitions are based on the collapsed state of the package. In the shown, open state according to FIGS. 5 and 6, the upper side 7 of the panel 2 is accordingly turned downward, while the under side 8 is turned upward in the drawing sheet.

In the base part 3, two bulgings or bubbles 9 are included, in which cutting inserts (or other articles) can be stored. Each individual bubble projects downward from the under side 6 of the panel 1 and mouths in an opening 10 in the upper side 5 thereof. The cover 4 is connected with the base part 3 via a hinge 11. In the embodiment shown, the base part and the cover are assumed to be made of a single, thermoformed and punched plastic piece, the hinge 11 being a simple folding indication that has been punched in the plastic material.

Characteristic of the invention is that the panels 1, 2 of the base part as well as of the cover include two seats 12*a*, 12*b* and 13*a*, 13*b*, respectively, which—in the lowered position of the cover—are laterally and equidistantly separated from the individual bubble 9, the individual seat having an available depth that amounts to half of the depth of the bubble.

In the shown, preferred embodiment, the individual seat 13 (and 12, respectively) as well as the individual bubble 9 has a round basic shape, more precisely by having a circular contour shape. As may be best seen in FIGS. 6 and 8, the individual bubble 9 includes on one hand a bottom 14, which in this case is plane and has a circular periphery, and on the other hand an endless wall 15 having a rotationally symmetrical shape. This wall may advantageously be at least partly conical. Thus, in the example shown, the wall 15 includes a lower portion 16 having a cylindrical shape, and an upper portion 17 having a conical shape. More precisely, said wall portion 17 converges in the direction from the opening 10 of the bubble toward the bottom 14 thereof. Imaginary, geometrical centre axes of the bubble and the seat 13, respectively, are designated C.

Reference is now made to FIG. 7, in which it is seen that the two bubbles 9 are mutually separated and located along a first, straight reference line RL1, while the pairs of seats 12*a*, 12*b* and 13*a*, 13*b*, respectively, are located along a second reference line RL2 perpendicular to the same. The situation of the bubbles as well as of the seats is defined by the centre axes C, which are centres of the circles that determine the round basic shape of the seats. The distance between the centre axes C of the bubbles 9 is designated L1, while the corresponding distance between the centre axes C of the seats is designated L2. In order for the two bubbles—in connection with stapling or packing together—to fit into two seats in an adjacent package, L1 and L2 should be essentially equally large.

Along the peripheries thereof, the panels 1 and 2 (see again FIGS. 5 and 6) transform into circumferential borders 18, 19 that extend downward from the under side 6, 8 of the respective panel 1, 2. The border 19 of the cover 4 is somewhat wider than the border 18 of the base part 3. In such a way, the border 19 will be located outside the border 18, when the cover is lowered. Each one of the borders 18, 19 transforms along a lower boundary line 20, 21 into a plane brim 22, 23 that protrudes laterally from said boundary line. In the example, the brims 22, 23 are circumferential in the same way as the borders, i.e., are running continuously along the peripheries of the panels. As is seen in FIGS. 9 and 10, the folding indication 11 serving as a hinge is punched in a transition between the two brims 22, 23. Furthermore, it is seen that the two brims 22, 23 are situated in a common plane or neutral plane NP, when the cover is folded out 180° in relation to the base part. In this state, the panel 2 of the cover together with the appurtenant border 19 are situated below the plane NP, while the panel 1 of the base part and the border 18 are situated above the same. Simultaneously, the bottoms of the bubbles 9 are situated in a plane in common with the panel 2 (which is parallel to the neutral plane NP).

The height H of the borders 18, 19 (see also FIG. 8) amounts to half (50%) of the depth D1 of the individual bubble 9. In FIG. 10, it is seen that the lower halves of the bubbles 9 are situated below the neutral plane NP, while the upper halves are situated above the same.

At the ends thereof spaced apart from the hinge 11, the above-mentioned brims 22, 23 are extended with material portions or tabs 24, 25, which together have the purpose of securing the cover against the base part. The tab 24 includes a hole 26 that has the purpose of allowing suspension of the package, e.g. on a carrying spear. The two tabs 25 include inwardly facing tongues, which compulsorily can be laid overlapping with analogous tongues of the opposite ends of the tab 24. In such a way, the cover and the base part can be locked in relation to each other in a way that makes more difficult or impossible to open the package unintentionally or by misadventure.

In the example shown, each one of the brims 22, 23 is formed so that parts of the same form a bottom 27 in the respective seat 12, 13. In this connection, it should, however, be mentioned that one or both seats may be entirely or partly open, i.e., lack such a bottom.

It should furthermore be pointed out that the parts of the borders 18, 19 that form walls 28, 29 in the individual seats have a circular basic shape. However, said walls only extend along a limited arc angle that is, on one hand, less than 360° and, on the other hand, greater than 180°. In the example, the arc angle of the walls amounts to approx. 270°. This means that the seats open not only upward, but also laterally. In such a way, it has been possible to give the package a rectangular basic shape so far that the distance L between the hinge 11 and the opposite end of the package has been made somewhat greater than the width W (see FIG. 7).

In each one of the four corners included in the border 19 of the cover 4, snap-in members 30 are formed, which co-operate with snap-in members 31 included in the corners of the border 18 of the base part. The snap-in members 30 are of a male-like character and placed on a certain level below the under side 8 of the cover panel 2, while the snap-in members 31 are female-like and located on the same level as the snap-in members 30. Similar snap-in members 32 of a male-like nature are also formed on the round limiting walls 29 of the seats 13*a*, 13*b*. These co-operate with female-like members 33 formed in the limiting walls 28 of the seats 12*a*, 12*b*. Therefore, when the cover 4 is lowered, the same will be attached by snap action against the base part 3 in totally eight points, viz. in the four corners and in paired opposite points along the round walls of the seats. In addition to the securing lock tabs 24, 25, accordingly the two package halves are held snapped together by means of said snap-in members. In practice, the cover can, when the securing flaps 24, 25 have been released from each other, be detached from the base part by means of a readily practicable pulling and turning operation. In this connection, it should be pointed out that the most essential snap-in action is effected by the two co-operating pairs of snap-in members 30, 31 that are situated farthest from the hinge 11.

Reference is now made to FIG. 8, in which it is seen that the individual package also includes an additional snap-in action that has the purpose of keeping together two adjacent packages of a bundle or pile. In FIG. 8, it is seen that an individual seat 13, in addition to the plane bottom 27, is delimited by a round wall 29 having a cylindrical shape. In other words, the wall 29 is assumed to be generated by a generatrix parallel to the centre axis C. In FIG. 8, the depth of the bubble 9 is designated D1. This depth is the level difference between the panel 1 and the bottom 14 of the bubble. The depth of the seat 13 is analogously calculated as the level difference between the panel 2 and the bottom 27 of the seat. This depth is determined by the height H of the border 19 and border wall 29. According to the invention, D1 is twice as large as H. In FIG. 8, it is furthermore seen that the conical upper part of the wall 15, which connects to the panel 1, has a greater depth D3 than the lower cylindrical part 16, which connects to the bottom 14 of the bubble 9. The depth D3 of the cone part 17 is greater than the depth of the seat, i.e., the height H of the border wall 29. In practice, D3 may amount to approx. 75% of D1. The cylinder part 16 of the bubble has an outer diameter that essentially corresponds with the inner diameter of the seat 13. When the bubble of a package is inserted into a seat 13 in an adjacent package, the cylinder part 16 will therefore be insertable essentially unresistingly into the seat, but as soon as the conical part 17 approaches the panel 2, said part will be deformed by being compressed radially and exert a light pressure against the interior of the seat. In practice, said pressure may be selected so that the packages are kept together, at the same time as the same can be detached from each other without considerable resistance, more precisely by the bubble being pulled out of the seat in connection with the cover being opened.

Reference is now made to FIGS. 1-4, and in particular to FIG. 2, in which it is seen that the package includes an information carrier 34, which in the example is in the form of a sheet of a suitable material, such as board, laminate or another relatively stiff material, on which information can be printed or applied. Via a folding line (not visible), the sheet is folded into two halves 35, 36 having approximately the same rectangular contour shape as the panels 1, 2 of the package. In each sheet half, round recesses 37 are recessed, in which the round cavities forming the seats 12, 13 can be housed. The individual sheet half has an outside 38 and an inside 39. One of the sheet halves, viz. the sheet half 36, has a projection area that is somewhat larger than the projection area of the other sheet half 35. This means that edge portions of the sheet half 36 will project in relation to the corresponding edge portions of the sheet half 35. In such a way, the sheet half 36 can be applied with its outside to the under side of the panel 2 of the cover, the four corners of the sheet half being housed and held in place between the male-like snap-in members 30 and the under side 8 of the panel 2. On the contrary, the edges of the somewhat smaller sheet half 35 clear from said snap-in members. In practice, this means that the sheet half 36 is retained against the under side of the cover, at the same time as the other sheet half 35 can be turned up to the position shown in FIG. 2.

Each sheet half can be provided with information on the inside 39 as well as the outside 38. This means that the outsides of the information carrier become visible from outside in the sealed state of the package (provided that the material is transparent). As soon as the package has been opened, the information on the insides 39 of the sheet halves is also readable.

As further seen in FIG. 2, two cutting inserts 40 are placed in the two bubbles 9 of the base part 3. These two cutting inserts are visible from outside at the same time as the information on the outside 38 of the sheet half 35 can be read by the observer.

The projection areas of the two panels 1, 2 and sheet halves 35, 36 are advantageously considerably larger than the total projection area of the two seats 13 and recesses 37, respectively. In practice, the first-mentioned projection surfaces should be at least three times larger than the last-mentioned ones. In the shown, preferred embodiment, the respective seat 13 has a projection area of approx. 4 $cm^2$, while the panels 1, 2 have a length of 63 mm and a width of 53 mm. In other words, the information-carrying projection area of the panel 2 amounts to 33 $cm^2$−2×4 $cm^2$=25 $cm^2$, the quotient amounting to 25/8=3.1.

Reference is now made to FIGS. 11 and 12, which illustrate how several packages can be packed together into a bundle or pile containing an arbitrary number of packages. In the figures, it is seen how an upper package, after rotation 90° in relation to a lower one, can be connected with the last-mentioned one by the two bubbles 9 of the upper package being brought down into the two seats 13*a*, 13*b* of the lower package. When the individual bubble bottoms in the appurtenant seat, the conical, upper part 17 of the bubble will—as described above—be compressed radially and abut against the surrounding limiting wall of the seat by a light pressure. Although the pressure is moderate—to facilitate separation of the packages—the same is fully sufficient to keep together the packages in a united set or bundle.

In FIGS. 13-22, an alternative embodiment of the invention is shown. In this case, the package has a three-cornered or trigonal shape and includes only one bubble 9 included in the base part 3 of the package. Said bubble 9 projects downward from the under side 6 of the panel 1, and is placed in the vicinity of a hinge 11 that connects the cover 4 with the base part 3. In each panel 1, 2, here, two seats 12*a*, 12*b*; 13*a*, 13*b* are also included. In this embodiment, said seats have the shape of through, circular holes, in which a likewise circular bubble 9 of an adjacent package can be inserted. The bubble 9 is located in a corner of an imaginary, equilateral triangle, in the two other corners of which the holes 12*a*, 12*b* are situated.

Characteristic of this embodiment is that the panel 1 of the base part 3 includes spacer members that project downward from the under side 6 of the panel. In the example, said spacer members have the shape of ring-shaped or arched bulges 41 formed adjacent to the respective hole. As may be best seen in FIGS. 17-20, the individual bulge 41 is a depression that is formed or coined in the plastic panel and opens upward and extends along an arc angle less than 360°. An analogous, although shorter bulge 42 is coined in the panel 2 of the cover, more precisely in the immediate vicinity of the hole 13. When the cover 4 is lowered against the base part 3, the bulges 42 (see FIG. 20) snap into the bulges 41 and lock the cover in a closed state.

Reference is now made to FIGS. 21 and 22, which schematically illustrate three packages, which are sealed and turned upside-down, i.e., the bubbles 9 and the bulges 41 are turned upward. As previously pointed out, the bulges 41 have a depth or a height H that amounts to one-third of the depth D1 of the bubble 9. The situation of the bubble 9 and bulges 41 in the lower package P1 is seen in FIG. 22. When the package P2 is to be piled on the package P1, the same is rotated 120° so that the its bubble 9 is located in the lower, left corner of the equilateral triangle according to FIG. 22. In doing so, the bubble 9 of the package P1 can be led up through the coinciding holes in the two collapsed panels of the package P2, at the same time as the last-mentioned ones come to rest against the two bulges 41 of the package P1, which in this respect serve as spacer members for the package P2. ⅔ of the bubble 9 of the package P1 will then protrude above the bulge 41 included in the package P2. When the third package P3 is to be piled on the package P2, the same is rotated additionally by 120° and is brought to rest against the two bulges 41 of the package P2, at the same time as the bubble 9 of the last-mentioned one is brought up through the left bulge 41 of the package P3 according to FIG. 21.

In the completed pile, the individual package will obtain a three-point support. In an arbitrarily large pile, each set of three packages will require a build height that does not exceed the depth of the individual bubble. In other words, also this package will be space-saving, when it is piled or packed.

Feasible Modifications of the Invention

The invention is not limited only to the embodiments described above and shown in the drawings. Thus, the shape of the storage bubble as well as of the seat (or hole) may deviate from the round or rotationally symmetrical shape shown in the drawings. Neither need the bubble and the seat have the same, mating shape. Thus, the essential is that the seat allows the bubble to be inserted into the same. Furthermore, the snap means, which have the purpose of detachably locking the cover in relation to the base part as well as keeping together packed-up packages, may be formed in miscellaneous ways that deviate from the embodiment examples. Also, the basic shape of the two alternative packages may deviate from the exemplified quadrangular and three-cornered ones, respectively. Furthermore, the hinge between the cover and the base part may be realized in another way than in the form of a punched folding indication. Although it is preferred to make the package in one piece of plastic, it is even feasible to manufacture the base part and the cover individually and then connect the same via the hinge.

The invention claimed is:

1. A package comprising:

two panels;

one of the panels being included in a base part having two bubbles for storage purposes, the two bubbles extending downward from an underside of the panel of the base part and mouthing in an opening in an upper side thereof, each of the bubbles including a bottom and an endless wall having a rotationally symmetrical shape; and the other panel being included in a cover, the cover being connected with the base part via a hinge turnable and rotatable between a raised position in which an interior of each of the two bubbles is accessible, and a lowered, closed position in which the panel of the covers the opening of the two bubbles, wherein each of the panels include two seats, which when the cover is in the lowered, closed position are laterally and equidistantly separated from the two bubbles, the two bubbles being mutually separated and located along a straight, first reference line, and the seats are located along a second reference line perpendicular to the first reference line, a mutual distance between the two bubbles being equal to a distance between the seats, the bubbles and the seats being of similar shape such that when the package is in the closed position the seats of the cover are arranged to receive bubbles of another, like package when the packages are stacked together.

2. The package according to claim 1, wherein each of the seats and the bubbles have a circular contour shape.

3. The package according to claim 1, wherein said wall converges in a direction from the opening of a bubble toward the bottom thereof.

4. The package according to claim 1, wherein the panel of the base part and cover each have a periphery and transform along their respective peripheries into a downwardly extending border, the border of the cover being located on an outside of the base part when the cover is lowered.

5. The package according to claim 4, wherein a height of each of the borders is half of a depth of an individual bubble.

6. The package according to claim 5, wherein each border transforms along a lower boundary line into a plane brim that protrudes laterally from the lower boundary line.

7. The package according to claim 6, wherein the brim extends to form a bottom of an individual seat.

8. The package according to claim 7, wherein each individual seat is delimited by a round wall having an arc angle greater than 180° but less than 360°.

9. The package according to claim 4, wherein each of the panels have a rectangular contour shape, said borders including four corner portions, at least the two of which are spaced farthest apart from the hinge and each of the panels including co-operating snap means for snapping the cover against the base part when the cover is in a lowered position.

10. The package according to claim 1, wherein a material of the base part and the cover is transparent, and that an information carrier formed as a sheet folded in two is arranged between an underside of the panel of the cover and an upper side of the panel of the base part.

11. The package according to claim 1, wherein the base part includes a solitary bubble situated in a corner of an imaginary, equilateral triangle, in the two other corners of which the two seats are situated.

12. The package according to claim 11, wherein the seats are through holes located in the panels of the base part and cover, the panel of the base part including spacer members that project downward from the underside of the panel of the base part and having a height that is one-third of a depth of the bubble.

13. The package according to claim 12, wherein each of the spacer members is an arched bulge situated in the vicinity of an individual through hole.

14. The package according to claim 1, wherein a projection area of an individual panel is at least three times larger than a total projection area of the two seats.

* * * * *